US009510074B2

(12) United States Patent
Lee et al.

(10) Patent No.: US 9,510,074 B2
(45) Date of Patent: Nov. 29, 2016

(54) GRATING ONLY OPTICAL MICROPHONE

(71) Applicant: Apple Inc., Cupertino, CA (US)

(72) Inventors: Jae H. Lee, Palo Alto, CA (US); Janhavi S. Agashe, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 156 days.

(21) Appl. No.: 14/325,204

(22) Filed: Jul. 7, 2014

(65) Prior Publication Data

US 2016/0007108 A1 Jan. 7, 2016

(51) Int. Cl.

| | |
|---|---|
| ***H04R 1/08*** | (2006.01) |
| ***H04R 23/00*** | (2006.01) |
| *H04R 7/18* | (2006.01) |

(52) U.S. Cl.

CPC ..... *H04R 1/08* (2013.01); *H04R 23/008* (2013.01); *H04R 7/18* (2013.01); *H04R 2201/003* (2013.01); *H04R 2307/207* (2013.01)

(58) Field of Classification Search

CPC . H04R 1/08; H04R 23/008; H04R 2201/003
USPC ..... 381/356, 26, 91, 92, 95, 111–115, 122, 381/151, 355, 369, 175, 375
See application file for complete search history.

(56) References Cited

U.S. PATENT DOCUMENTS

| | | | |
|---|---|---|---|
| 6,154,551 | A | 11/2000 | Frenkel |
| 7,134,343 | B2 | 11/2006 | Suzuki et al. |
| 7,277,642 | B2 | 10/2007 | Shinzou |
| 7,518,737 | B2 | 4/2009 | Hall et al. |
| 8,261,602 | B2 | 9/2012 | Degertekin |
| 8,503,701 | B2 | 8/2013 | Miles et al. |
| 2002/0039463 | A1 | 4/2002 | Degertekin et al. |
| 2004/0130728 | A1 | 7/2004 | Degertekin et al. |
| 2005/0195400 | A1 | 9/2005 | Anderson et al. |
| 2007/0028695 | A1 | 2/2007 | Suzuki et al. |
| 2007/0165896 | A1 | 7/2007 | Miles et al. |

(Continued)

FOREIGN PATENT DOCUMENTS

| | | |
|---|---|---|
| DE | 102012200957 | 1/2013 |
| EP | 1500913 | 1/2005 |

OTHER PUBLICATIONS

Apple Inc., PCT Search Report and Written Opinion dated Sep. 4, 2015, PCT/US2015/036818.

(Continued)

*Primary Examiner* — MD S Elahee
(74) *Attorney, Agent, or Firm* — Blakely, Sokoloff, Taylor & Zafman LLP

(57) ABSTRACT

A micro-electro-mechanical system (MEMS) optical sensor including an enclosure having a top wall, a bottom wall and a sidewall connecting the top wall and the bottom wall. The sensor further including a compliant membrane positioned within the enclosure, which is configured to vibrate in response to an acoustic wave and having a grating formed therein. A reflector is formed directly on an inner surface of one of the bottom wall or the top wall of the enclosure. A light emitter is positioned within the enclosure along a side of the compliant membrane opposite the reflector, the light emitter is configured to transmit a laser light toward the grating and the reflector. A light detector is positioned along the side of the compliant membrane opposite the reflector, the light detector configured to detect an interference pattern of the laser light, which is indicative of an acoustic vibration of the compliant membrane.

20 Claims, 5 Drawing Sheets

(56) References Cited

U.S. PATENT DOCUMENTS

| | | | |
|---|---|---|---|
| 2013/0142519 | A1 | 6/2013 | Iwamoto et al. |
| 2014/0084394 | A1 | 3/2014 | Je |
| 2014/0210020 | A1 | 7/2014 | Dehe |

OTHER PUBLICATIONS

Bicen, Baris , et al., "Integrated Optical Displacement Detection and Electrostatic Actuation for Directional Optical Microphones With Micromachined Biomimetic Diaphragms", *IEEE Sensors Journal*, vol. 9, No. 12, (Dec. 2009), 1933-1941.

Bicen, Baris , "Micromachined Diffraction Based Optical Microphones and Intensity Probes With Electrostatic Force Feedback", Retrieved from the Internet: smartech.gatech.edu/bitstream/handle/1853/41065/bicen_baris_201008_phd.pdf, (Aug. 1, 2010).

Kuntzman, et al., "Performance and Modeling of a Fully Packaged Micromachined Optical Microphone", *Journal of Microelectromechanical Systems*, vol. 20, No. 4, (Aug. 2011), 828-833.

Suzuki, Kazuhiro, et al., "Novel MEMS Optical Microphone with Grating Diaphragm", International conference on Electrical Engineering (ICEE), (2004), 4 pages.

Apple Inc., PCT Search Report and Written Opinion dated Sep. 16, 2015, PCT/US2015/036810.

Apple Inc., Non-Final Office Action mailed Feb. 11, 2016, U.S. Appl. No. 14/611,948.

Bicen, B., et al., "Optical Microphone", Micromachined Sensors and Transducers Laboratory (MiST), Retrieved via Internet at old.me.gatech.edu/mist/microphone.htm on Mar. 13, 2014, 2 pages.

Hall, Neal A., et al., "Simulation of Thin-Film Damping and Thermal Mechanical Noise Spectra for Advanced Micromachined Microphone Structures", *Journal of Microelectromechanical Systems*, vol. 17, No. 3, (Jun. 2008), 688-697.

GRATING ONLY OPTICAL MICROPHONE

FIELD

An embodiment of the invention is directed to a micro-electro-mechanical system (MEMS) device, more specifically, a MEMS optical microphone having a single plate. Other embodiments are also described and claimed.

BACKGROUND

MEMS devices generally range in size from about 20 micrometers to about 1 millimeter and are made up of a number of even smaller components which can be formed in layers on a substrate using various MEMS processing techniques (e.g. deposition processes, patterning, lithography, etching, etc.). MEMS devices can be processed for many different applications, for example, they may be sensors or actuators. One example of a MEMS sensor is a laser microphone. A MEMS laser, or optical, microphone refers to a microphone which uses a laser beam to detect sound vibrations of an associated diaphragm. The microphone may include two essentially flat, horizontally arranged, surfaces. One of the surfaces may be a diaphragm, which can vibrate in response to sound waves, and the other surface may be a substantially stiff structure having a grating. A light emitter and a light detector may be associated with a substrate positioned below the flat surfaces. The light emitter may be a laser (e.g. a vertical cavity surface emitting laser (VCSEL)) configured to direct a light beam toward a reflective portion of the diaphragm. Typically, the substantially stiff structure having the grating is positioned between the diaphragm and the light emitter such that the light beam first passes through the grating. The light beam is diffracted by the grating and then reflected off of the reflective portion of the diaphragm back to the light detector. The light detector detects the interference pattern created by the diffracted light rays and converts the light into an electrical signal, which corresponds to an acoustic vibration of the diaphragm, which in turn provides an indication of sound.

SUMMARY

An embodiment of the invention is directed to a MEMS sensor which can be formed by MEMS processing techniques and includes a single plate suspended within the sensor to facilitate sound detection. Representatively, in one embodiment, the MEMS sensor is a very high signal-to-noise ratio (SNR) laser (or optical) microphone. Representatively, the MEMS optical sensor may include an enclosure having a top wall, a bottom wall and a sidewall connecting the top wall and the bottom wall. The sensor may further include a compliant membrane positioned within the enclosure, which is configured to vibrate in response to an acoustic wave and having a grating formed therein. A reflector is formed directly on an inner surface of one of the bottom wall or the top wall of the enclosure. A light emitter is positioned within the enclosure along a side of the compliant membrane opposite the reflector. For example, the light emitter is positioned between a side (e.g. a face) of the compliant membrane and the top wall while the reflector is positioned between another side of the compliant membrane and the bottom wall. Alternatively, the light emitter is positioned within the enclosure between a side of the compliant membrane and the bottom wall while the reflector is positioned between another side of the compliant membrane and the top wall. The emitter is configured to transmit a laser light toward the grating and the reflector. A light detector is positioned along the same side of the compliant membrane as the light emitter, the light detector configured to detect an interference pattern of the laser light, which is indicative of an acoustic vibration of the compliant membrane.

A further embodiment of the invention includes a MEMS optical sensor having an enclosure including a wall upon which a reflector is positioned. The sensor further includes a diaphragm positioned within the enclosure, the diaphragm having a grating, the grating spaced a distance above the reflector. A light emitter is positioned above the diaphragm, the light emitter configured to transmit a laser light toward the grating and the reflector. A light detector is positioned above the diaphragm, the light detector configured to detect an interference pattern of the laser light after reflection from the reflector, wherein the interference pattern is indicative of an acoustic vibration of the diaphragm.

A further embodiment of the invention includes an optical microphone system including a MEMS microphone enclosure having an acoustic port. A reflector is formed on an inner surface of the enclosure. A diaphragm is positioned within the enclosure, the diaphragm having a grating that is spaced a distance from the reflector. A light emitter is positioned on an inner surface of the enclosure that is different from the reflector, the light emitter configured to transmit a laser light toward the grating and the reflector. A light detector is positioned along the same inner surface as the light emitter, the light detector configured to detect an interference pattern of the laser light after reflection from the reflector. The system further including circuitry connected to one or more of the diaphragm and the reflector. The circuitry may be used to tune the distance between the diaphragm and the reflector.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
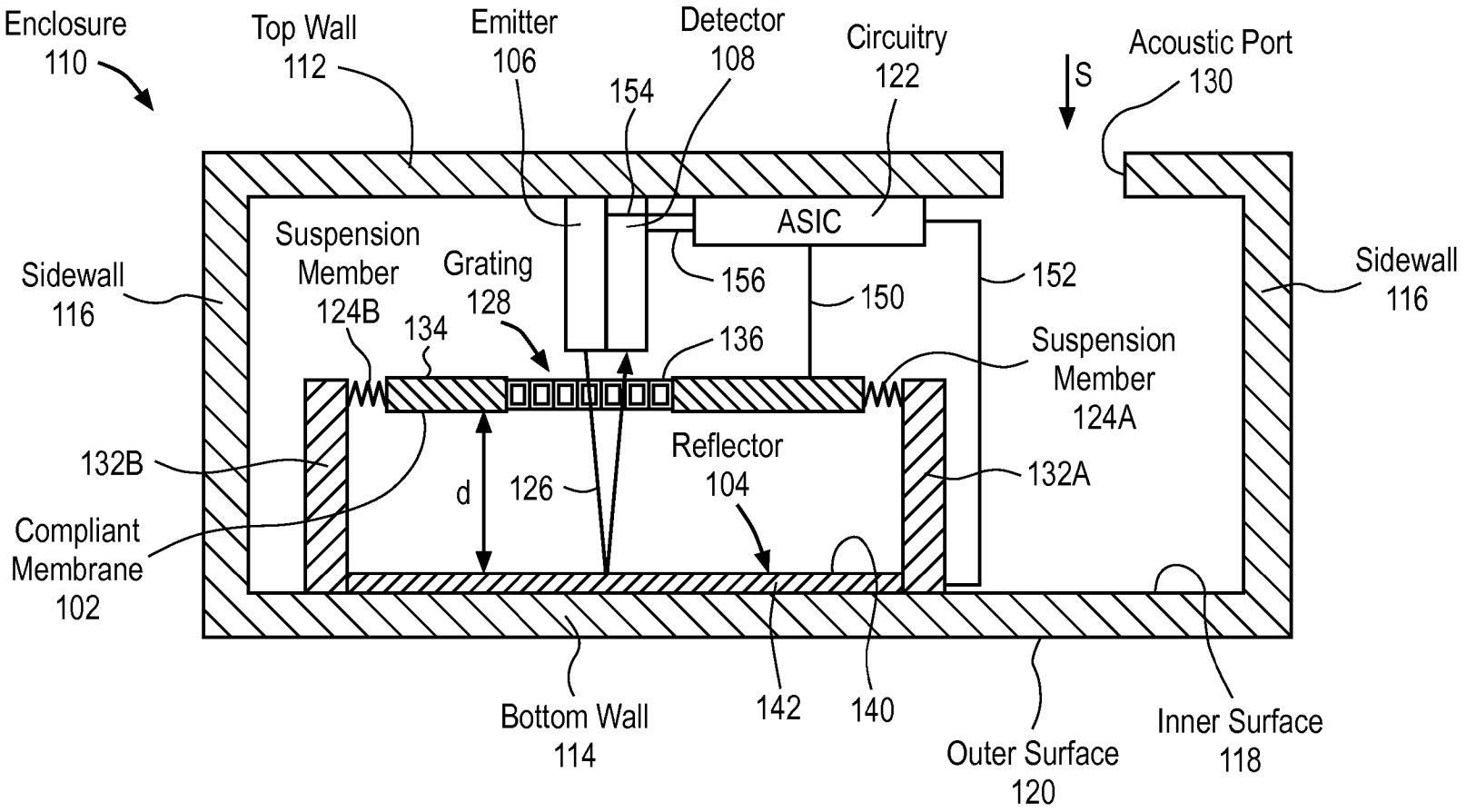
FIG. 1 illustrates a cross-sectional side view of one embodiment of a MEMS optical microphone.

FIG. 1 illustrates a cross-sectional side view of one embodiment of a MEMS optical microphone. Microphone 100 may include a plate such as a compliant membrane 102, a reflector 104, a light emitter 106, a light detector 108 and circuitry 122 positioned within enclosure 110. Enclosure 110 may be any type of enclosure suitable for forming a housing or packaging around the microphone components. Enclosure 110 may include at least one acoustic port 130 such that sound (S) from the ambient environment outside of enclosure 110 may enter enclosure 110.

In one embodiment, enclosure 110 includes a top wall 112, a bottom wall 114 and at least one sidewall 116. Acoustic port 130 may be formed through any one of top wall 112, bottom wall 114 and sidewall 116. Sidewall 116 may connect the top wall 112 to the bottom wall 114. Each of the top wall 112, bottom wall 114 and sidewall 116 have an inner surface 118 and an outer surface 120. The inner surface 118 being the surface facing the interior space within enclosure 110 and the outer surface 120 being the surface facing the ambient environment, outside of enclosure 110. The top wall 112 and the bottom wall 114 may run substantially parallel to one another. Sidewall 116 may be substantially perpendicular to each of the top wall 112 and bottom wall 114, or it may be slanted. In one embodiment, enclosure 110 may have a relatively low z-height (i.e. top wall 112 and bottom wall 114 are relatively close together) such that a distance between top wall 112 and bottom wall 114 is relatively small. In one embodiment, each of top wall 112, bottom wall 114 and sidewall 116 are integrally formed with one another as one inseparable structure. In other words, enclosure 110 is a single integrally formed unit. In this aspect, each of walls 112, 114 and 116 may be made of the same material. For example, walls 112, 114, 116 of enclosure 110 may be formed from a plastic material. It is further contemplated that in some embodiments, one or more of walls 112, 114, 116 are formed by a substrate with electrical contacts formed therein (e.g. a printed circuit board) to facilitate electrical connections with the various microphone components discussed herein.

Compliant membrane 102 may be a substantially planar plate like structure that is suspended within enclosure 110 and capable of vibrating in response to sound (S). Representatively, compliant membrane 102 may also be referred to as a diaphragm or sound pick up membrane that can be used within an acoustic-to-electric transducer or sensor which converts the sound wave induced by the mechanical motion of the diaphragm to an electrical signal (e.g. a microphone). In one embodiment, compliant membrane 102 may be suspended between top wall 112 and bottom wall 114 such that it is parallel to the walls, in other words faces the walls. In addition, it is important that compliant membrane 102 be spaced a distance (d) above reflector 104. Representatively, in one embodiment, compliant membrane 102 may be suspended above reflector 104 by suspension members 124A and 124B, which suspend compliant membrane 102 from support members 132A and 132B. In one embodiment, support members 132A and 132B may be posts that extend vertically upward from inner surface 118 of bottom wall 114 as shown in FIG. 1. In other embodiments, support members 132A and 132B may extend vertically downward from inner surface 118 of top wall 112. Support members 132A and 132B may be integrally formed with enclosure 110, or they may be separate structures mounted to the inner surface 118 of enclosure 110 after they are formed.

Suspension members 124A and 124B may have any size and dimension suitable for suspending compliant membrane 102 from support members 132A and 132B. It is further important that suspension members 124A and 124B be compliant or elastic members that allow for vertical movement of compliant membrane 102 (e.g. movement of compliant membrane 102 in a z-height direction) such that compliant membrane 102 can vibrate in response to sound and a distance (d) between compliant membrane 102 and reflector 104 can be tuned, in some cases, to improve a resonance of an interference pattern used to provide an indication of sound, as will be discussed in more detail below. Representatively, in one embodiment, suspension members 124A and 124B may be spring like structures. For example, in one embodiment, suspension members 124A and 124B may be springs formed by corrugations within the outer edges of compliant membrane 102. Suspension members 124A and 124B may be integrally formed from the same material as compliant membrane 102, or separately formed structures which are attached between the outer edges of compliant membrane 102 and support members 132A and 132B.

Compliant membrane 102 may include an outer frame portion 134 and a grating 128. Outer frame portion 134 may be a rigid portion, which surrounds grating 128. Grating 128 may be vertically aligned with reflector 104. Grating 128 is also aligned with light emitter 106 and light detector 108 such that light emitted by light emitter 106 toward, and reflected from, reflector 104 passes through grating 128. Grating 128 is dimensioned to form an interference pattern that can be detected by light detector 108 and used as an indicator of a movement of compliant membrane 102. Since the pattern represents a displacement of the compliant membrane 102, it can be used to provide an indication of sound using a diffraction based optical interferometer method or any other optical interferometric method. Representatively, in some embodiments, grating 128 may also include a reflective coating 136 to facilitate formation of the interference pattern. Reflective coating 136 may be, for example, a metallic coating (e.g. a gold coating) applied to grating 128 during a MEMS processing operation (e.g. a deposition process).

In some embodiments, grating 128 is integrally formed within frame portion 134 of compliant membrane 102, such as by a MEMS processing technique (e.g. patterning, etching or the like). For example, in some embodiments, compliant membrane 102 is a substantially solid membrane having grating 128 formed within frame portion 134 such that it is within a center portion of membrane 102. In other words, the only openings within compliant membrane 102 are those within grating 128. Such a configuration is illustrated in more detail in FIG. 2.

Figure 2:
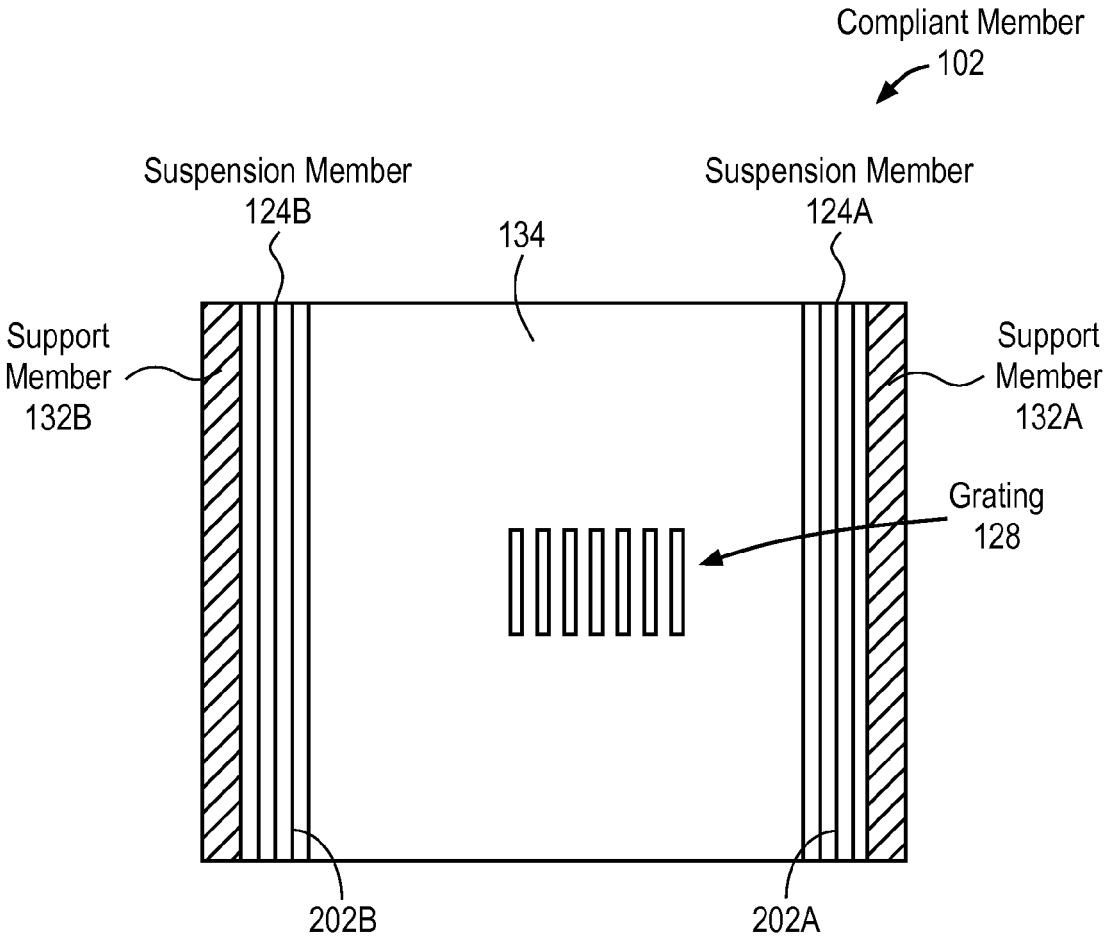
FIG. 2 illustrates a top plan view of a compliant membrane of the MEMS optical microphone of FIG. 1.

Representatively, FIG. 2 illustrates a top view of compliant membrane 102. From this view, it can be seen that compliant membrane 102 may have, for example, a square shaped frame portion 134 within which grating 128 is formed. Alternatively, compliant membrane 102 may have any type of quadrilateral shape, or other shapes, for example, a circle, ellipse, oval or the like. Grating 128 may have a periodic structure sufficient to split and diffract light emitted from an emitter (e.g. emitter 106) into different beams for detection by a detector (e.g. detector 108). In some embodiments, the grating 128 causes the formation of an interference pattern which can be used to indicate a movement of compliant membrane 102 in response to sound waves, and in turn, as an indicator of sound. Grating 128 may be formed in a portion of compliant membrane 102 which is aligned with reflector 104, and emitter 106/detector 108. In the illustrated embodiment, grating 128 is formed in a center portion of frame portion 134.

Suspension members 124A, 124B are formed along sides of frame portion 134 of compliant membrane 102 and can be used to attach compliant membrane 102 to support members 132A, 132B. Suspension members 124A, 124B can run along an entire length of the sides of frame portion 134 or less than the entire length. Suspension members 124A, 124B can be made from the same material layer used to form compliant membrane 102 such that they are integrally formed with compliant membrane 102 using MEMS processing techniques. For example, the frame portion 134 of compliant membrane 102 may be wider on the side where it is desirable to have suspension members 124A, 124B. Corrugations 202A, 202B may then be formed in the extra width portion to form an elastic structure that functions as a spring. In other embodiments, suspension members 124A, 124B may have any structure sufficient to suspend compliant membrane 102 from support members 132A, 132B. For example, in other embodiments, suspension members 124A, 124B may be relatively narrow structures that do not extend the entire length of the edges of compliant membrane 102. In this aspect, spaces may be formed between edges of frame portion 134 and support members 132A, 132B such that fluid (e.g. a gas or liquid) can flow between the structures.

In other embodiments, increased fluid flow through compliant membrane 102 may be accomplished by suspending grating 128 within an opening of compliant membrane 102, for example, by springs or spoke like structures. Representatively, frame portion 134 may have a larger opening (i.e. larger than grating 128) and grating 128 may be suspended within the opening by springs. Compliant membrane 102, including grating 128 and suspension members 124A and 124B, may be manufactured using MEMS processing techniques (e.g. deposition processes, patterning, lithography, etching, etc.).

Returning now to FIG. 1, reflector 104 may be a rigid member positioned along an inner surface 118 of enclosure 110. Representatively, in one embodiment, reflector 104 is formed directly on inner surface 118 and compliant membrane 102 is positioned a distance (d) over or above reflector 104. Said another way, reflector 104 is under or below compliant membrane 102. For example, in one embodiment, reflector 104 may be a reflective substrate (e.g. a substrate with a metallic coating such as gold) which includes a top side 140 facing compliant membrane 102 and a bottom side 142 which contacts, and is mounted to, inner surface 118 of bottom wall 114. In another embodiment, reflector 104 may be a reflective coating (e.g. a metallic coating such as gold) applied directly to inner surface 118 of bottom wall 114. Moreover, since reflector 104 is positioned or formed directly on a wall of enclosure 110 such as by applying a metallic or reflective coating to wall 114 or by making wall 114 of a reflective material (e.g. a metallic material), and compliant membrane 102 is the only plate or membrane suspended within microphone 100 and/or formed by a MEMS processing technique, microphone 100 may be considered a "single plate" optical microphone or "single MEMS plate" microphone. Said another way, microphone 100 is considered to include only a single moving surface (i.e. compliant membrane 102) since, as previously discussed, reflector 104 is rigid and formed on or as part of a wall of enclosure 110.

Reflector 104 is considered "rigid" relative to compliant membrane 102 in that it does not vibrate in response to sound (S) in the same manner as compliant membrane 102. In addition, reflector 104 is considered to be in a fixed and stationary position with respect to bottom wall 114. In other words, reflector 104 does not move (i.e. is immovable) in a vertical, a horizontal or other direction during operation of microphone 100. It is further to be understood that although reflector 104 is shown on inner surface 118 of bottom wall 114, reflector 104 could also be positioned on an inner surface of top wall 112, and in some cases even sidewall 116. For example, in one embodiment, compliant membrane 102 may be oriented within enclosure 110 such that it faces a sidewall 116 (e.g. the left sidewall) and reflector 104 could be positioned on the other sidewall 116 (e.g. the right sidewall). Reflector 104 can have any size and shape sufficient to reflect the light beam 126 emitted from light emitter 106 back toward detector 108.

In addition, it is important that a distance (d) be maintained between reflector 104 and compliant membrane 102 as this area provides a resonant cavity within which light 126 can bounce back and forth between reflector 104 and compliant membrane 102. The interference pattern created by these multiple reflections is then used by a diffraction based optical interferometer method or any other optical interferometric method to provide an indication of sound. In some embodiments, distance (d) may therefore be tuned to improve a resolution of the interference pattern created by the light reflections between reflector 104 and compliant membrane 102. Representatively, as previously discussed, reflector 104 is at a fixed position on bottom wall 114. In this aspect, to tune distance (d) (e.g. decrease or increase distance (d)), compliant membrane 102 can be moved either toward or away from reflector 104 to achieve a desired distance (d), while reflector 104 stays in the same position. Thus, since distance (d) can be tuned, the use of microphone 100 is not limited to an enclosure of any particular z-height. Rather, compliant membrane 102 can be moved toward or away from reflector 104 to maintain the desired distance (d) for optimal resolution.

In one embodiment, the distance (d) between compliant membrane 102 and reflector 104 can be tuned electrically by applying a voltage to one or more of compliant membrane 102 and reflector 104 using circuit 122. Circuit 122 is connected to compliant membrane 102 and reflector 104 by wires 150, 152, respectively. For example, in one embodiment, to tune distance (d), reflector 104 may be grounded and a voltage is applied by circuit 122 to compliant membrane 102 through wire 150. The voltage induces an electrostatic charge between compliant membrane 102 and reflector 104, which will in turn, draw compliant membrane 102 (and also grating 128) toward reflector 104, thereby reducing distance (d). In some embodiments, distance (d) is tuned to any integer multiple of ¼ λ of the laser light 126 found suitable to improve the resolution.

It is further noted that distance (d) between compliant membrane 102 and reflector 104 can also help to reduce a "squeeze film" effect of microphone 100. The squeeze film effect refers to a phenomenon that occurs when air passes between two plates in close proximity. By maintaining distance (d) between compliant membrane 102 and reflector 104, and being able to tune this distance (d), a more open air passageway may be created. As a result, the noise penalty due to the squeeze film effect is reduced Returning now to circuit 122, circuit 122 may also be connected to emitter 106 and detector 108 by wires 154, 156, respectively. Circuit 122 may receive power from an external source and provide power to one or more of compliant membrane 102, reflector 104, emitter 106 and/or detector 108. In some embodiments, emitter 106 may be a light source such as a VCSEL. Emitter 106 may be configured to emit a laser light (or beam) in the direction of grating 128 and reflector 104, for detection by detector 108. Detector 108 may, in some embodiments, be a photo detector configured to detect a reflected light (or beam) generated by emitter 106. The emitter 106 (e.g. VCSEL) and detector 108 (e.g. photo detector) can be off the shelf commercially available parts or custom built for a specific implementation.

One or more of the various components of microphone 100 (e.g. compliant membrane 102, reflector 104, support members 132A, 132B, emitter 106 and/or detector 108) may be formed and assembled using MEMS processing techniques (e.g. deposition processes, patterning, lithography, etching, etc.). For example, in one embodiment, support members 132A, 132B may be the sidewalls of a cavity formed within a substrate and compliant membrane 102 may be formed in the cavity. Representatively, a compliant membrane material and sacrificial layer may be stacked in the cavity. The compliant membrane material may then be etched or patterned to form compliant membrane 102 having suspension members 124A, 124B and grating 128. The sacrificial layer may then be removed to form a space below compliant membrane 102. This preformed MEMS structure may then be mounted within enclosure 110, over reflector 104, and the space will provide the distance (d) between compliant membrane 102 and reflector 104 as previously discussed.

Figure 3:
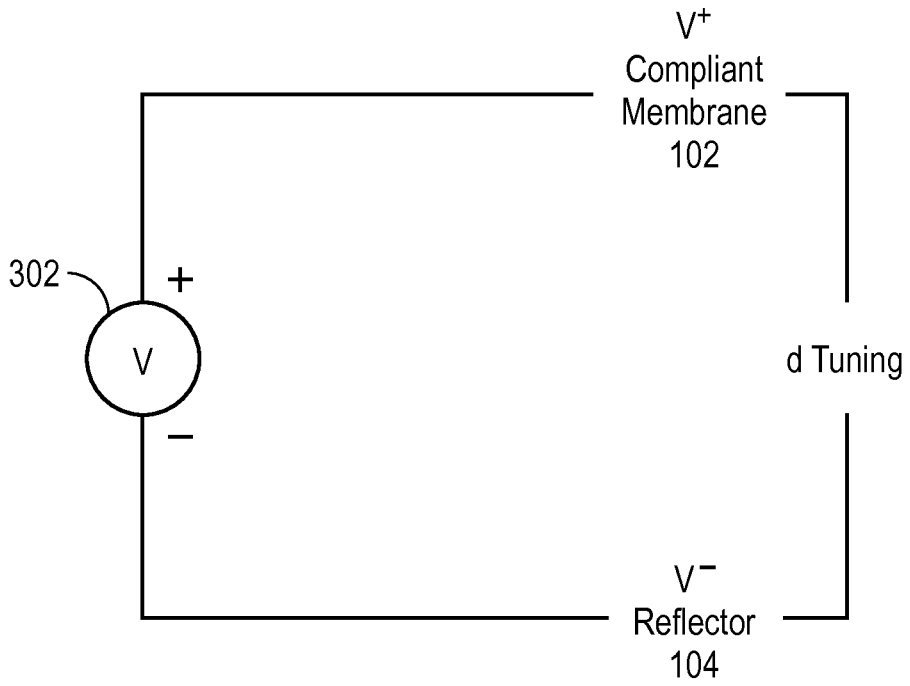
FIG. 3 illustrates a circuit arrangement for controlling the MEMS optical microphone of FIG. 1.

FIG. 3 illustrates a circuit arrangement for controlling the MEMS optical microphone of FIG. 1. Representatively, FIG. 3 illustrates a voltage source 302 which can be connected to compliant membrane 102 and reflector 104. In one embodiment, to tune distance (d), reflector 104 is grounded and voltage V− is held at zero (or constant) while voltage V+ to compliant membrane 102 is applied (or if already applied, varied). It is further contemplated, that in some embodiments, reflector 104 may not be grounded and reflector voltage V− may instead be varied while compliant membrane voltage V+ remains constant to tune distance (d).

Figure 4:
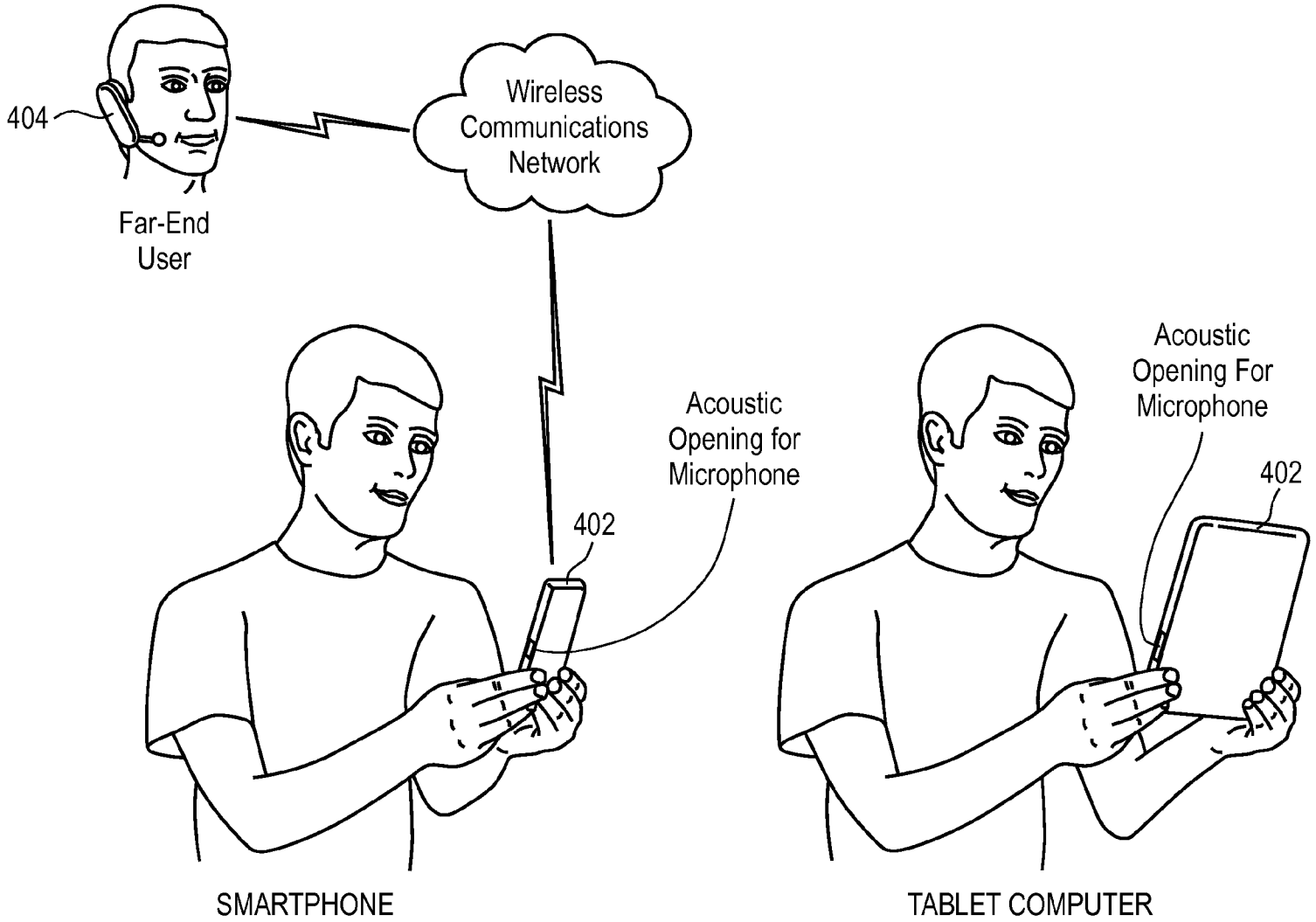
FIG. 4 illustrates one embodiment of a simplified schematic view of one embodiment of an electronic device in which the optical microphone may be implemented.

FIG. 4 illustrates one embodiment of a simplified schematic view of one embodiment of an electronic device in which a MEMS optical microphone, or other MEMS device described herein, may be implemented. As seen in FIG. 4, the MEMS device may be integrated within a consumer electronic device 402 such as a smart phone with which a user can conduct a call with a far-end user of a communications device 404 over a wireless communications network; in another example, the MEMS device may be integrated within the housing of a tablet computer. These are just two examples of where the MEMS device described herein may be used; it is contemplated, however, that the MEMS device may be used with any type of electronic device in which a MEMS device, for example, an optical MEMS microphone, is desired, for example, a tablet computer, a desk top computing device or other display device.

Figure 5:
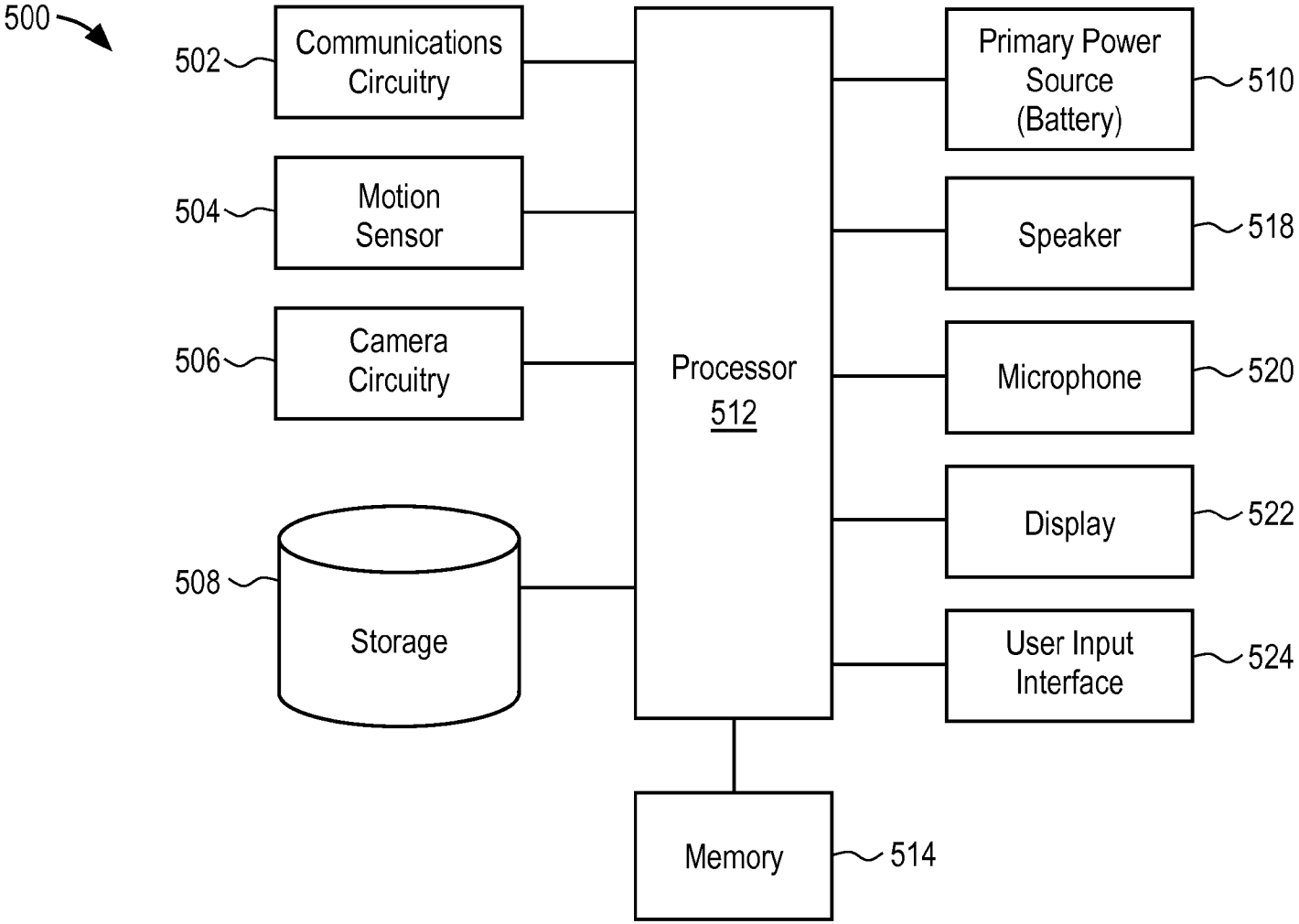
FIG. 5 illustrates a block diagram of some of the constituent components of an embodiment of an electronic device in which an embodiment of the invention may be implemented.

FIG. 5 illustrates a block diagram of some of the constituent components of an embodiment of an electronic device in which an embodiment of the invention may be implemented. Device 500 may be any one of several different types of consumer electronic devices. For example, the device 500 may be any microphone-equipped mobile device, such as a cellular phone, a smart phone, a media player, or a tablet-like portable computer.

In this aspect, electronic device 500 includes a processor 512 that interacts with camera circuitry 506, motion sensor 504, storage 508, memory 514, display 522, and user input interface 524. Main processor 512 may also interact with communications circuitry 502, primary power source 510, speaker 518, and microphone 520. Microphone 520 may be an optical microphone such as optical microphone 100 such as that described in reference to FIG. 1. The various components of the electronic device 500 may be digitally interconnected and used or managed by a software stack being executed by the processor 512. Many of the components shown or described here may be implemented as one or more dedicated hardware units and/or a programmed processor (software being executed by a processor, e.g., the processor 512).

The processor 512 controls the overall operation of the device 500 by performing some or all of the operations of one or more applications or operating system programs implemented on the device 500, by executing instructions for it (software code and data) that may be found in the storage 508. The processor 512 may, for example, drive the display 522 and receive user inputs through the user input interface 524 (which may be integrated with the display 522 as part of a single, touch sensitive display panel). In addition, processor 512 may send an audio signal to speaker 518 to facilitate operation of speaker 518.

Storage 508 provides a relatively large amount of "permanent" data storage, using nonvolatile solid state memory (e.g., flash storage) and/or a kinetic nonvolatile storage device (e.g., rotating magnetic disk drive). Storage 508 may include both local storage and storage space on a remote server. Storage 508 may store data as well as software components that control and manage, at a higher level, the different functions of the device 500.

In addition to storage 508, there may be memory 514, also referred to as main memory or program memory, which provides relatively fast access to stored code and data that is being executed by the processor 512. Memory 514 may include solid state random access memory (RAM), e.g., static RAM or dynamic RAM. There may be one or more processors, e.g., processor 512, that run or execute various software programs, modules, or sets of instructions (e.g., applications) that, while stored permanently in the storage 508, have been transferred to the memory 514 for execution, to perform the various functions described above.

The device 500 may include communications circuitry 502. Communications circuitry 502 may include components used for wired or wireless communications, such as two-way conversations and data transfers. For example, communications circuitry 502 may include RF communications circuitry that is coupled to an antenna, so that the user of the device 500 can place or receive a call through a wireless communications network. The RF communications circuitry may include a RF transceiver and a cellular baseband processor to enable the call through a cellular network. For example, communications circuitry 502 may include Wi-Fi communications circuitry so that the user of the device 500 may place or initiate a call using voice over Internet Protocol (VOIP) connection, transfer data through a wireless local area network.

The device may include a microphone 520. Microphone 520 may be a MEMS optical microphone such as that described in reference to FIG. 1. In this aspect, microphone 520 may be an acoustic-to-electric transducer or sensor that converts sound in air into an electrical signal. The microphone circuitry (e.g. circuit 122) may be electrically connected to processor 512 and power source 510 to facilitate the microphone operation (e.g. tilting).

The device 500 may include a motion sensor 504, also referred to as an inertial sensor, that may be used to detect movement of the device 500. The motion sensor 504 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RF or acoustic doppler detector, a compass, a magnetometer, or other like sensor. For example, the motion sensor 504 may be a light sensor that detects movement or absence of movement of the device 500, by detecting the intensity of ambient light or a sudden change in the intensity of ambient light. The motion sensor 504 generates a signal based on at least one of a position, orientation, and movement of the device 500. The signal may include the character of the motion, such as acceleration, velocity, direction, directional change, duration, amplitude, frequency, or any other characterization of movement. The processor 512 receives the sensor signal and controls one or more operations of the device 500 based in part on the sensor signal.

The device 500 also includes camera circuitry 506 that implements the digital camera functionality of the device 500. One or more solid state image sensors are built into the device 500, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 508. The camera circuitry 506 may also be used to capture video images of a scene.

Device 500 also includes primary power source 510, such as a built in battery, as a primary power supply.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the devices and processing steps disclosed herein may correspond to any type of optical sensor that could benefit from a single plate or membrane configuration, for example, an inertial sensor, an accelerometer, a gyrometer or the like. The description is thus to be regarded as illustrative instead of limiting.

What is claimed is:

1. An optical microphone comprising:

an enclosure having a top wall, a bottom wall and a sidewall connecting the top wall and the bottom wall;

a compliant membrane suspended within the enclosure by a suspension member, the compliant membrane configured to vibrate in response to an acoustic wave and having a grating formed therein, and wherein the suspension member is formed from a material of the compliant membrane and extends along an entire length of at least one side of the compliant membrane;

a reflector formed directly on an inner surface of one of the bottom wall or the top wall of the enclosure;

a light emitter positioned within the enclosure along a side of the compliant membrane opposite the reflector, the light emitter configured to transmit a laser light toward the grating and the reflector; and a light detector positioned along the side of the compliant membrane opposite the reflector, the light detector configured to detect an interference pattern of the laser light after reflection from the reflector, wherein the interference pattern is indicative of an acoustic vibration of the compliant membrane.

2. The optical microphone of claim 1 wherein the suspension member is a corrugated structure formed from a material layer of the compliant membrane.

3. The optical microphone of claim 1 wherein the compliant membrane comprises 1) the grating formed within a rigid frame portion of the compliant membrane and 2) a compliant outer portion that is attached to a support member.

4. The optical microphone of claim 1 wherein the top wall, the bottom wall and the sidewall are integrally formed with one another from a same material, and wherein the reflector is a metal coated substrate having a top side facing the grating and a bottom side mounted directly to one of the top wall or the bottom wall.

5. The optical microphone of claim 1 wherein the reflector is a metal coating applied to the inner surface.

6. The optical microphone of claim 1 wherein the reflector is immovable relative to the compliant membrane.

7. The optical microphone of claim 1 wherein the reflector is formed on the bottom wall and the enclosure further comprises an acoustic port formed through the top wall.

8. A micro-electro-mechanical system (MEMS) optical microphone comprising:

a MEMS optical microphone enclosure having a first wall upon which a reflector is positioned and a second wall through which an acoustic port is formed;

a diaphragm suspended within the enclosure by a suspension member that is suspended from a diaphragm support member, the diaphragm support member extending from the first wall toward the second wall of the enclosure, the diaphragm having a grating, the grating spaced a distance above the reflector;

a light emitter positioned above the diaphragm, the light emitter configured to transmit a laser light toward the grating and the reflector; and a light detector positioned above the diaphragm, the light detector configured to detect an interference pattern of the laser light after reflection from the reflector, wherein the interference pattern is indicative of an acoustic vibration of the diaphragm.

9. The optical microphone of claim 8 wherein the suspension member is a spring.

10. The optical microphone of claim 8 wherein the reflector comprises a reflective plate mounted directly to an inner surface of the first wall.

11. The optical microphone of claim 8 wherein the reflector comprises a reflective coating applied to an inner surface of the first wall.

12. The optical microphone of claim 8 further comprising circuitry connected to the diaphragm and the reflector, the circuitry operable to apply a voltage one or more of the diaphragm and the reflector to tune the distance.

13. The optical microphone of claim 12 wherein the distance is tuned by moving the diaphragm while the reflector remains stationary.

14. The optical microphone of claim 8 wherein a vertical position of the reflector with respect to the first wall is fixed.

15. An optical microphone system comprising:

a MEMS microphone enclosure having an acoustic port;

a reflector formed on an inner surface of the enclosure;

a diaphragm positioned within the enclosure, the diaphragm having a grating that is spaced a distance from the reflector;

a light emitter positioned on an inner surface of the enclosure that is different from the reflector, the light emitter configured to transmit a laser light toward the grating and the reflector;

a light detector positioned along the same inner surface as the light emitter, the light detector configured to detect an interference pattern of the laser light after reflection from the reflector; and circuitry connected to one or more of the diaphragm and the reflector, wherein the circuitry is operable to apply a voltage to the diaphragm to tune the distance between the grating and the reflector.

16. The system of claim 15 wherein the reflector comprises a gold coating applied to the inner surface of the enclosure.

17. The system of claim 15 wherein the distance between the diaphragm and the reflector is tuned by moving the diaphragm while the reflector remains stationary.

18. The system of claim 15 wherein the voltage is used to tune the distance to any integer multiple of $\frac{1}{4}\lambda$ of the laser light.

19. The system of claim 15 wherein the reflector is fixedly attached to the inner surface of the enclosure.

20. The system of claim 15 wherein the reflector is formed on the inner surface of a bottom wall of the enclosure and the light emitter and the light detector are formed on the inner surface of a top wall of the enclosure.

* * * * *